United States Patent [19]

Bricmont

[11] Patent Number: 4,991,276

[45] Date of Patent: Feb. 12, 1991

[54] FLEXIBLE CONVEYANCE AND GUIDANCE ROLLER FOR USE IN METALWORKING FURNACE STRUCTURES

[75] Inventor: Francis H. Bricmont, McMurray, Pa.

[73] Assignee: Bricmanage, Inc., McMurray, Pa.

[21] Appl. No.: 387,141

[22] Filed: Jul. 31, 1989

[51] Int. Cl.[5] ..... B21B 31/08

[52] U.S. Cl. ..... 29/124; 29/130; 29/132

[58] Field of Search ..... 29/124, 125, 130, 132; 165/90, 91; 432/236, 246

[56] References Cited

U.S. PATENT DOCUMENTS

| | | | |
|---|---|---|---|
| 2,045,773 | 6/1936 | Harvey | 432/236 |
| 2,085,575 | 6/1937 | Desbordes et al. | 29/125 X |
| 2,592,581 | 4/1952 | Lorig . | |
| 2,660,429 | 11/1953 | Lorig . | |
| 2,720,692 | 10/1955 | Lorig . | |
| 2,772,879 | 12/1956 | Lorig . | |
| 3,213,513 | 10/1965 | Robertson | 29/125 X |
| 3,860,387 | 1/1975 | Bricmont . | |

FOREIGN PATENT DOCUMENTS

| | | | |
|---|---|---|---|
| 0846969 | 7/1981 | U.S.S.R. | 432/236 |
| 429626 | 6/1935 | United Kingdom | 432/246 |

OTHER PUBLICATIONS

SMS Schloemann-Siemag Aktiengesellschaft brochure entitled "CSP Compact Strip Production", Aug. 1987.

*Primary Examiner*—Timothy V. Eley
*Attorney, Agent, or Firm*—Clifford A. Poff

[57] ABSTRACT

There is provided a roller apparatus for use in a metallic workpiece heating furnace or the like, the apparatus serving to guide and convey the workpieces through the furnace while at the same time avoiding localized cooling of the workpieces during heating thereof. The apparatus comprising an elongated arbor formed of two concentric tubes having internal openings for coolant extending in the axial direction of the arbor. The arbor further has secured there around a series of spaced wheel-like workpiece supporting structures each including hub members having toe portions welded to the outer concentric tube and head portions which are free to slide relative to the outer concentric tube. Positioned along the outer concentric tube between and outside of the wheel-like workpiece supporting structures are packets of parallel abutting ring or disc members formed of thermally insulating material. The roller apparatus deflects under the weight of the workpiece supported thereon so as to permit the apparatus to assume a catenary shape to positively guide the workpieces in their passage through the furnace.

16 Claims, 4 Drawing Sheets

FLEXIBLE CONVEYANCE AND GUIDANCE ROLLER FOR USE IN METALWORKING FURNACE STRUCTURES

BACKGROUND OF THE INVENTION

1. Field of the Invention:

The present invention relates to conveyance roller structures, in general, and to rollers for supporting and guiding metallic workpieces during heating within a furnace, in particular.

2. Description of the Prior Art:

In the past, rollertype hearths have been provided in furnaces to support numerous different forms of workpieces as, for example, a plurality of bars or slabs during heating within the furnace. Heavy metallic slabs have been heated by conveying them through successively arranged furnaces or tandem heating zones within one or more furnaces. Such workpieces are heated for a number of different reasons, all of which usually are characterized by the need to supply heated workpieces from the furnaces at a uniform temperature. The actual temperature to which these workpieces are heated depends upon the particular metalworking or treating operations but, generally, the workpieces are raised to a temperature above the critical temperature of the metal and frequently it is desired to raise the temperature of the workpiece to 2,000° F. or higher.

In some heating furnace designs, water-cooled skids are used to support the workpiece during heating. The results, however, are undesirable because pronounced cold spots are formed at each area where the workpiece was supported o the skids. This is particularly undesirable where the workpieces are heated prior to quenching, rolling, leveling and other processing operations involving metal deformations. There are other forms of furnace hearths known in the art which involve the use of rollers to support the workpiece. These rollers are typically constructed through the use of a tri-union mounted to the ends of an alloyed tube forming the roller body. The temperature of the roller is increased in essentially the same manner as the workpiece supported thereby during heating.

An improved version of such rollers is disclosed in U.S. Pat. No. 3,860,387. As disclosed therein, the roller comprises a central, axially-extending, fluid-cooled arbor surrounded by an outer tubular sleeve member which is in contact with the workpieces being heated. There is an annular space between the outer periphery of the arbor and the inner periphery of the sleeve. In this space are arcuate segments for supporting the sleeve on the arbor without materially transmitting heat from the hot outer tubular sleeve to the inner fluid cooled arbor. That is, the arcuate segments provide sufficient structural support for the outer, hot sleeve which may be at a temperature of at least 2,000° F. and the inner, much cooler fluid-cooled arbor such that the arbor does not act as a heat sink so as to produce cold spots on the outer periphery of the annular sleeve which would deleteriously affect the characteristics of the workpiece being heated.

Such a roller is useful for preventing unwanted cold spots on workpieces which are heated in the furnace. However, such a design provides no means for positively guiding or tracking a plate-like workpiece as it passes through a furnace. Without means for positively guiding a workpiece through the furnace, the workpiece may bump the walls of the furnace or even become jammed therein. Obviously, such bumping or jamming of the workpiece within the furnace may produce damage to the workpiece and/or the furnace which oftentimes requires a shutdown operation to remove the workpiece from the furnace. Such shutdowns are costly and inefficient work stoppages and are sometimes of rather great duration if significant maintenance is required to repair a damaged furnace. Therefore, other guide means must be provided to positively guide the workpiece through the furnace.

Unfortunately, however, additional guide means add undesirable cost increased heat loss and complexity to the furnace design. And even when equipped with such guides means, such a system is limited in the thickness of workpiece it can accommodate. Such a system can only be effectively used on thick workpieces having a high degree of structural integrity, i.e., workpieces which will not become too soft and then become damaged through contact with guide means within the furnace. And, as can be appreciated, the greater the thickness of the workpiece, generally the more treatment is required to reduce the workpiece to a final thickness--especially if the workpiece is to be formed into thin coiled steel strip. For obvious reasons, greater thickness rolling reductions of the workpiece adds to the manufacturing cost and time required for forming the final product.

Flexible roller designs have been introduced for guiding a metallic strip workpiece as it is conveyed through the various "unheated" workstations of a production plant. Such roller designs advantageously eliminate the need for additional workpiece guide means structure to be provided. However, such designs are of no use in a high-heat furnace environment since they are formed of materials which will become severely damaged if not completely destroyed under the extreme heat conditions experienced within a furnace. Examples of such "self-centering" strip rollers are disclosed in U.S. Pat. Nos. 2,592,581—2,660,429 —2,720,692 and 2,772,879. Each of these patents, with the exception of U.S. Pat. No. 2,660,429, disclose roller structures formed of rubber, leather, fabric or other resilient material which would be destroyed by the roughly 2,000° F. temperature produced within the heating and soaking furnace of a rolling mill production plant. U.S. Pat. No. 2,660,429 discloses an embodiment of a roller having a series of axially-spaced webs projecting from an arbor structure. However, if such a roller structure were to be subjected to the heat produced within a heating and soaking furnace and the constant weight of metallic workpieces, the laterally unsupported webs as well as the arbor will be subject to accelerated creep and permanent distortion.

An advantage exists, therefore, for a flexible conveyance and guidance roller structure for use in furnaces which avoids the creation of undesirable cold spots on the surface of a workpiece being heated while at the same time positively guides through the furnace—without any additional guide means—a class of thin, flexible and wide workpieces having little inherent structural integrity which heretofore could not be effectively passed through a furnace. With the provision of a system of such roller structures, which have particular use with thin continuously - cast plate or strip, significant reductions in cost and time are achieved in producing the final product. Still further, such a system will simplify and revolutionize the design and reduce the cost of construction of reduction mills by eliminating the need for a number of the roughing and/or finishing trains required to work a workpiece to a final product thickness.

It is therefore an object of the invention to provide an improved roller structure for positively guiding and conveying workpieces through a furnace.

It is a further object of the invention to provide a flexible roller structure for guiding and conveying workpieces through a furnace without the need for additional guide means.

It is a further object of the invention to provide a roller structure for guiding and conveying thin workpieces having little inherent structural integrity through a furnace.

It is a further object of the invention to provide a roller structure for imparting negligible cold spot areas to workpieces being heated as the workpieces are passed through a furnace.

It is yet a further object of the invention to provide a furnace roller structure which is of simple and inexpensive construction.

It is a further object of the invention to provide a system of workpiece guidance and conveyance roller structures for permitting a reduction in cost and time in producing a final workpiece product.

It is still a further object of the present invention to provide a roller structure system for permitting simplification of the design and a reduction in the construction cost of a reduction mill.

Still other objects and advantages will become apparent in light of the attached drawing figures and written description of the invention presented hereinbelow.

SUMMARY OF THE INVENTION

There is provided a roller apparatus for use in a metallic workpiece heating furnace or the like, the apparatus serving to guide and convey the workpieces through the furnace while at the same time avoiding localized cooling during heating of the workpieces. The apparatus comprises an elongated arbor formed of two concentric tube means having internal openings for coolant extending in the axial direction of the arbor. The arbor further has secured there around a series of spaced wheel-like workpiece supporting means, each including hub members having toe portions welded to the outer concentric tube means and base portions which are free to expand axially relative to the outer concentric tube means. Positioned along the outer concentric tube means between and outside of the wheel-like workpiece supporting means are packets of parallel abutting ring or disc members formed of thermally insulating material. The roller apparatus deflects under the weight of the workpieces supported thereon so as to permit the apparatus to assume a catenary shape to positively guide the workpieces in their passage through the furnace.

DESCRIPTION OF THE PREFERRED EMBODIMENT

Figure 1:
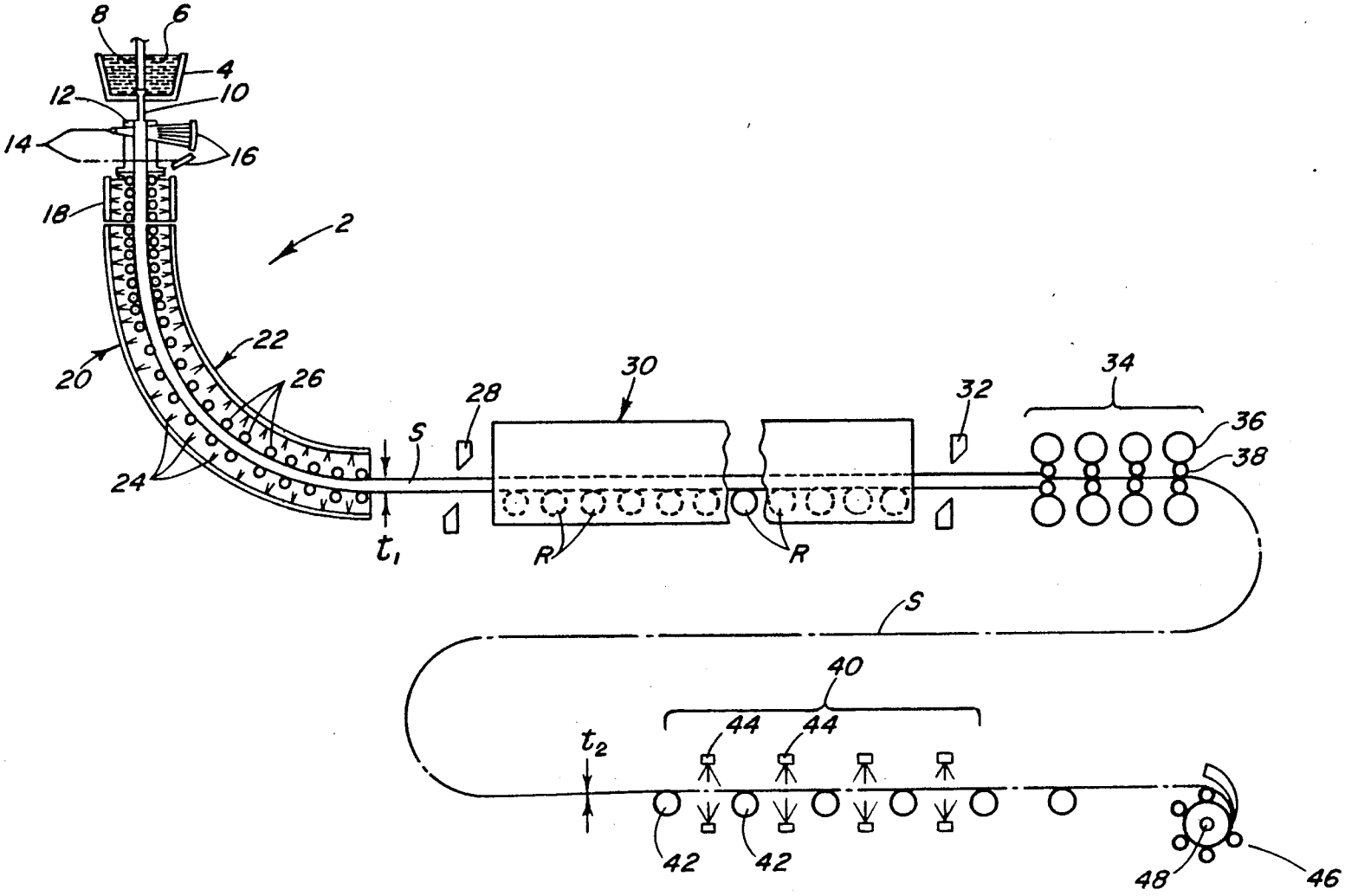
FIG. 1 is a schematic view of a continuous casting system and a reduction mill system having a furnace which uses the roller apparatus of the present invention.

Depicted in FIG. 1 is a preferred application of the roller apparatus of the present invention. In that figure, there is illustrated a continuous casting device 2 including a tundish 4 for containing a quantity of molten metal 6 and a stopcock means 8 for dispensing a desired quantity of the molten metal 6 from the tundish 2. At such time when the stopcock means 8 is raised within the tundish 4 a quantity 10 of the molten metal 6 is permitted to flow by gravity into water-cooled oscillating mold 12. It is in the mold 12 that molten metal 6 first begins to solidify. A pair of gamma ray sources 14 are positioned to one side of the oscillating mold 12 and project gamma rays through the mold 12. The gamma rays are then detected by receivers 16 which determine and control the desired level of metal 6 to be maintained in the mold 12.

The metal then exits the mold 12 and enters into a first straight section 18 of a water spray cooling zone 20. Straight section 18 is secured to and oscillates with the mold 12. Below straight section 18 is a separate stationary curved section 22 of water spray cooling zone 20. As the metal passes through water spray cooling zone 20, it is sprayed by water spraying devices 26 which are provided along the entire length of the water spray cooling zone 20. The metal, which is cast so as to be formed as a strip "S" is caused to pass smoothly into the straight section 18 and then follow the curvature of the curved section 22 by virtue of contact with a plurality of pairs of opposed rollers 26 provided along the length of the water spray cooling zone 20.

When the strip "S" exits the continuous casting device 2 it is most preferably of a thickness "$t_1$" of approximately 1.5 to 2.5 inches and between approximately 36 and 65 inches in width. The strip "S" then passes through a first flying shear 28 20 and then into a furnace 30 which is between 500 and 800 feet in length. The strip "S", being relatively thin, becomes quite soft and malleable when heated to the working temperatures within the furnace which are typically on the order of 2200° F. Being so soft, the strip "S" cannot be guided through the furnace 30 with conventional guide means which may cause damage such as gouging, scratching or tearing or jamming of the strip through incidental contact therewith.

Therefore, in accordance with the present invention, the strip "S" is conveyed and guided through the furnace 30 by means of a plurality of unique driven roller means "R", to be described in greater detail hereinbelow, which assume a catenary shape along their rotational axes when subjected to the weight of the strip. Across its width, the heated and softened strip sags and conforms to the shape of the catenary formed by the roller means "R" and is gently but positively guided through the furnace solely by the structure of the roller means "R" thus eliminating the need for any additional guide means which might damage the strip "S" as it passes thereby. An illustration of this situation is most clearly seen in FIG. 6

As the strip "S" exits furnace 30 it passes by a second flying shear 32 and then to a finishing train 34. Rolling Mill train 34 is formed of a plurality of four-high rolling mill stands each having back-up rolls 36 and working rolls 38. After treatment by the finishing train 34 the strip is reduced from approximately 1.5 to 2.5 inches down to a thickness "$t_2$" of approximately 0.1 to 0.6 inches. The shears 28 and 32 allow for severing the strip during normal operation as to coil size for maintenance operation.

The number of rolling mill stands used in the finishing train 34 can be varied as desired depending on the thickness of the strip as cast and the final desired "after-rolling" thickness of the strip.

From the finishing train 34 the strip is delivered to a run-out table 40 having driven conveyor rollers 42. Also associated with run-out table 40 are a plurality of water spraying devices 44 which provide a final cooling treatment to the strip "S" before it is coiled by a conventional down-coiler 46 having a collapsible mandrel 48.

Figure 2:
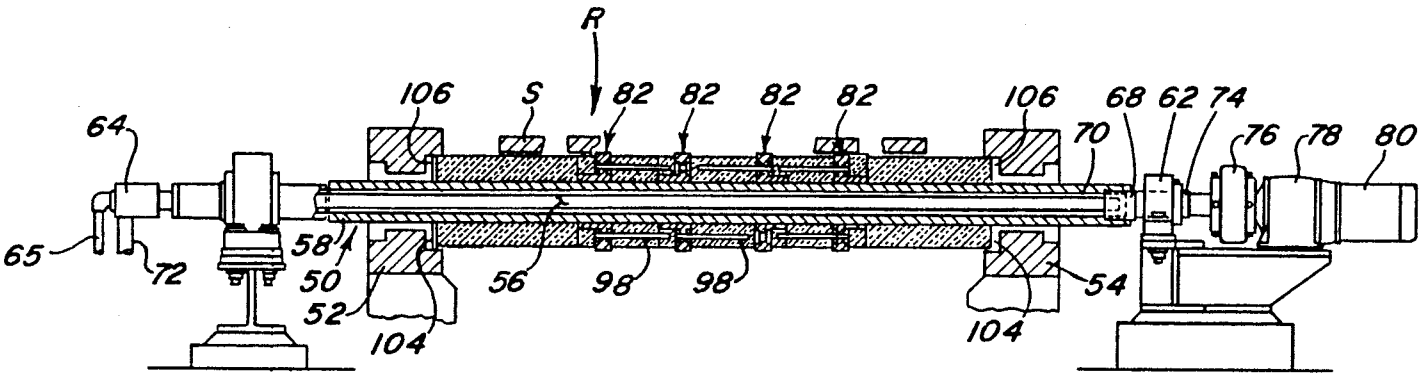
FIG. 2 is a view in partial section of the roller apparatus of the present invention.

FIG. 2 illustrates a preferred embodiment of the roller means "R" of the present invention which finds particular use in the furnace 30 depicted in FIG. 1.

The roller means "R" is comprised, inter alia, of an arbor 50 which passes at its opposite ends through apertures provided in opposite sidewalls 52 and 54 of furnace 30. The arbor 50 is formed of an inner tubular member 56 which is surrounded by an outer tubular member 58. The outer diameter of the inner tubular member 56 is less than the inner diameter of the outer tubular member 58 so that an annular fluid passageway 70 is formed between tubular members 56 and 58 which will be described in more detail hereinbelow.

Figure 4:
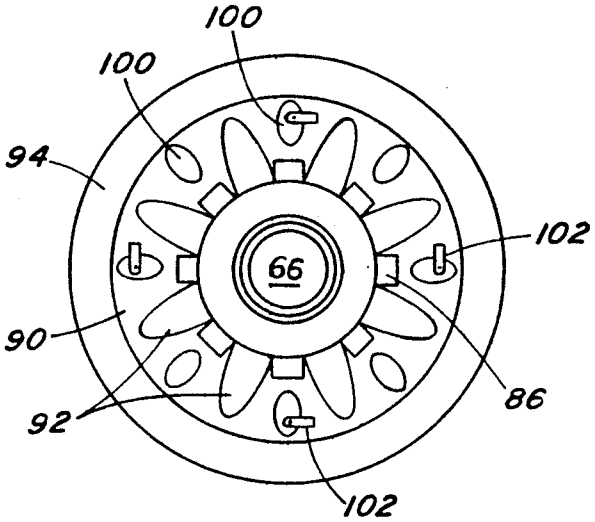
FIG. 4 is a view of the wheel-like workpiece support means as seen along line IV—IV of FIG. 3 with some elements omitted for purposes of clarity.

At each of its ends and exteriorly of each furnace sidewall 52 and 54, the arbor 50 is rotatably supported in pillow block bearings 60 and 62, respectively. At a first end thereof arbor 50 is attached to a rotary fluid coupling 64. Coolant is circulated through the arbor 50 via rotary coupling 64 as follows. Rotary coupling 64 receives pressurized coolant fluid from a coolant fluid source (not shown) through coolant fluid intake line 65 and transmits the coolant to an inner fluid passage 66 (FIG. 4) of inner tubular member 56. The coolant fluid travels along inner fluid passage 66 until it reaches plug means 68 which is suitably secured, as by threading or welding for example, to a second end of outer tubular member 58. The coolant fluid passing through inner fluid passage 66 is redirected upon contact with plug means 68 to flow in a reverse direction back through the aforesaid annular fluid passage 70, through rotary coupling 64 and fluid discharge line 72 to adjacent rolls, a drum bore back to the coolant fluid source. With such a coolant system in combination with other structure to be described later, the arbor 50 is advantageously cooled without acting as a heat sink which would produce undesirable cold spots on the periphery of the roller means "R" which would detrimentally affect the metallurgical characteristics of the workpiece being heated. Furthermore, the structural integrity of the arbor 50 is maintained by the cooling effect of the coolant, i.e., the arbor resists accelerated creep and sagging promoted by the combination of the weight of the strip "S" and the high heat produced within the furnace 30.

As noted previously, the second end of arbor 50 is provided with a plug means 68. Plug means 68 is part of a rotatable shaft 74 which is supported in pillow block bearing 62. The end of shaft 74 opposite to plug means 68 is secured to a flexible coupling means 76 which is connected to a driven shaft of a gear reducer 78. The gear reducer 78 is driven by a motor means 80. The motor means 80 and gear reducer 78 for each roller permit the speeds of rotation of the plurality of roller means "R" to be varied as desired in order to gradually increase the conveyance speed of the strip "S" in its travel through the furnace 30 so that it may exit the furnace 30 at a speed sufficient to enter and be treated by finishing train 34.

Figure 3:
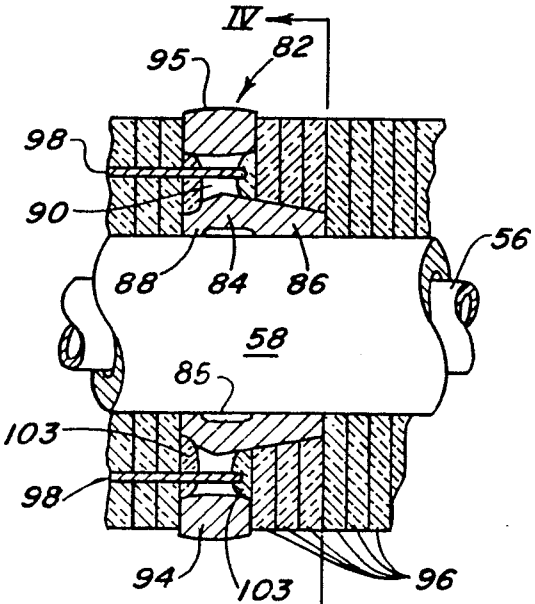
FIG. 3 is an enlarged partial sectional view of a section of the roller apparatus illustrated in FIG. 2.
Figure 3A:
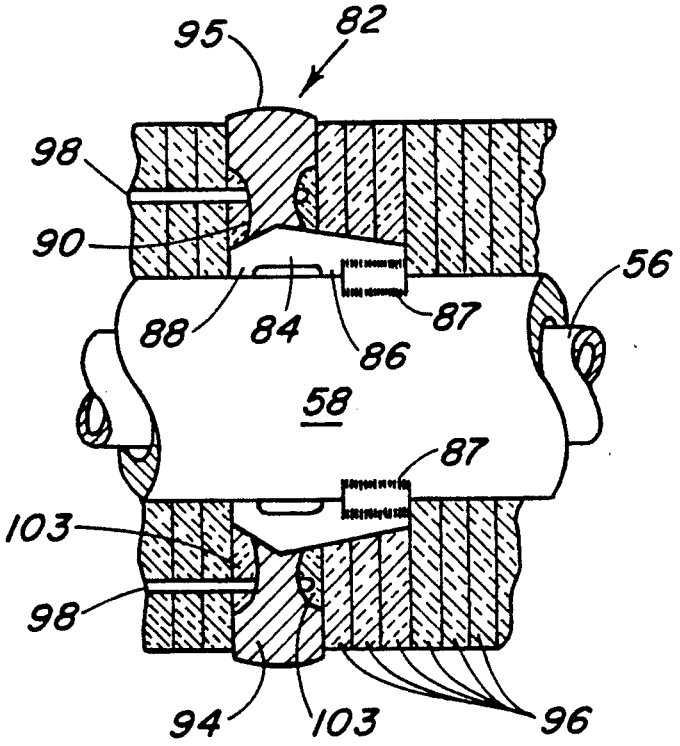
FIG. 3A is a partial sectional view similar to FIG. 3 but further showing the attachment of the wheel-like workpiece supporting mean to the roller.

As can be seen in FIG. 2 and especially in FIG. 3, there are a plurality of (preferably four) workpiece supporting means in the form of spaced wheel means 82 formed of thermally dimensionally stable and heat-damage resistant material which are welded to the outer tubular member 58 of arbor 50. The wheel means 82 are preferably formed of thermally dimensionally stable alloys such as alloys of cobalt, aluminum, iron, nickel, niobium, stainless steel, or the like, in order to minimize heat transfer to the arbor 50. Wheel means 82 include inner hub sections formed of a plurality of angularly spaced base members 84 each having toe portions 86 and head portions 88 separated by a recess or gap 85 extending in the direction of the length of said arbor means 50. The spaced apart toe and head portions and the spacing between the base members 84 serve to minimize metal to metal contact, thus also heat flow to arbor 50. With reference to FIG. 3A, it can be seen that only a short length weld 87 at each lateral side of each toe portion 86 interconnects about 75% of the length of the toe portion to the outer tubular member 58 while each head portion 88 is unattached and free to slide relative to outer tubular member 58 in response to the effect of differential expansion caused by a relatively large thermal gradient in the roller means "R" and the bending effect of the weight of the strip means "S" upon the roller means "R". As can be most clearly seen in FIGS. 6 and 7, the roller means "R" assumes the shape of a catenary when the weight of a strip "S" is supported thereon. Radially outwardly extending from each base member 84 is a web portion 90. Each web portion 90 is angularly separated from an adjacent web portion by an open space 92. Along with the minimal contact by base member 84 with the tubular arbor 50, the reduced cross sectional area making up the web portion because of the open spaces 92 further serve to reduce and impede heat flow to the water cooled arbor 58 by way of the base numbers 84. The segmented construction of the base members and extremely small volume of weld metal 87 reduces the heat conducting metal area to the arbor 50 even further. This permits the maximum surface temperature of the wheel surfaces thus avoiding cold spots on the strip "s". At their radially outermost extent, web portions 90 diverge and meet to form a continuous annular support for an outer workpiece-engaging rim means 94 having a surface 95 for contacting a workpiece such as strip "S". The design of the wheel and its method of attachment provide the minimum heat loss and thermal stress in the wheel while providing the maximum surface temperature on its outer perimeter.

Referring to FIGS. 2 and 3, it can be seen that in between and outside of wheel means 82 along the arbor 50 are packets of laminar abutting flexible discs 96 preferably formed of thermally-insulating ceramic fiber blanket materials; asbestos refractory materials, or the like.

The discs 98 are preferably formed to be of a diameter which is slightly less then the outermost diameter of rim means 94. Securing the packets of discs 96 between the wheel means 82 are metal rod means 98 which pass through the packets of discs 96 between each of the wheel means 82. The metal rod means 98 pass through apertures 10 formed in web portions 90 and have bent portions 102 formed at their ends for abutting against the web means 90 and anchoring the packets of discs 96 to the wheel means 82. Bulk ceramic fiber material 103 is packed on both sides of the web portions 90 of each wheel means where the metal rod means 98 pass through the web portions, i.e., at apertures 100. The bulk ceramic material 103, when compressed by the placement of discs 96, is compressed so as to be substantially as wide as rim means 94, to thus provide a substantially planar surface on each side of the web means 90 such that the positioning of the discs 98 is substantially parallel to orientation of the wheel means 82. The packets of discs 96 outside of the wheel means 82, i.e., the packets of discs 96 closest to the walls 52 and 54 of furnace 30, are retained by washers 104 which are welded to the outer tubular member 58 of arbor 50. Recesses 106 are formed in each of furnace walls 52 and 54 provide space for axial expansion of the arbor 50. As an alternative to disks 96, castable refractory material may be used between the wheel means 82 in order to insulate the roller means "R", if desired.

As can be readily appreciated, the provision of spaced wheel means 82 provides a limited degree of surface contact between the roller means "R" and the strip "S". Such limited surface contact reduces the likelihood of imparting undesirable cold spots by the roller means "R" onto the strip "S". Further ensuring the prevention of cold spots are the packets of insulation discs 96 which extend along the portion of the arbor 50 between furnace walls 52 and 54 and which prevent the temperature of the fluid-cooled arbor 50 from detrimentally affecting the strip "S" in any way. Conversely, the insulation discs 96 also prevent the heat from the furnace and/or the strip from detrimentally affecting the cooled arbor 50. It also reduces heat loss to water cooled surfaces. Furthermore, the close and dense packing of the discs 96 along the arbor 50 serves to provide lateral support for the web portions 90 of wheel means 82 to aid in preventing distortion thereof under the stresses caused by the weight of the strip "S" in combination with the high heat of the furnace.

Figure 5:
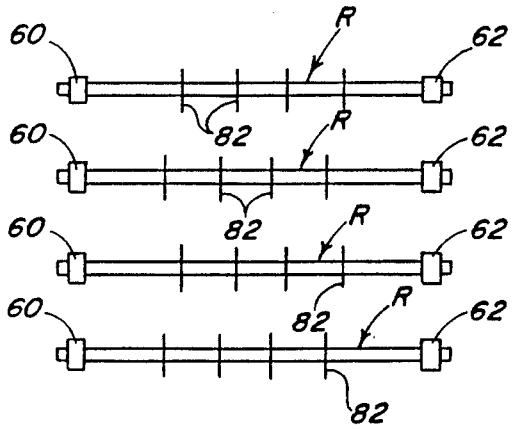
FIG. 5 is a schematic plan view illustrating a staggering in the location of the wheel-like workpiece support means in a series of alternating ones of the roller devices of the present invention positioned along the length of a furnace structure.

As seen in FIG. 5, each successive roller means "R" has its plurality of wheel means 82 staggered relative to the plurality of wheel means of an adjacent roller means. This further ensures the prevention of cold spots on the heated strip "S" by providing a discontinuous and brief period of contact between the workpiece contacting surface 95 of rim means 94 and the heated strip "S". Reduction of the duration of contact between the wheel means 82 and a given portion of the strip "S" further reduces the likelihood that the wheel means 82 ca act as a heat sink to produce cold spots on the heated strip.

Figure 6:
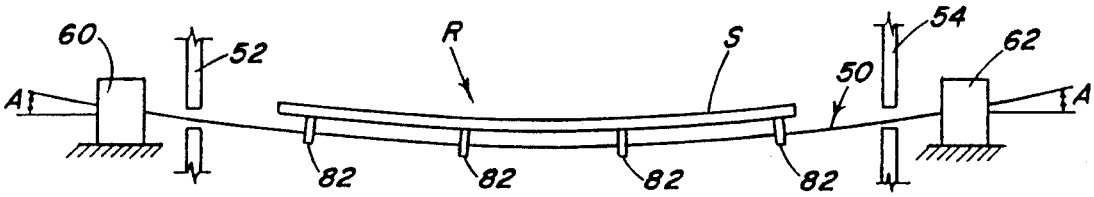
FIG. 6 is a schematic view of the roller apparatus of the present invention assuming a catenary shape when supporting the weight of a thin, wide metallic workpiece thereon.

Depicted in FIG. 6, in somewhat exaggerated form, is an illustration of the flexing of the roller means "R" under the weight of the heated strip "S" and how the roller means obtains a catenary shape in axial direction to positively track the strip "S" as it passes through the furnace 30 without the need for any additional guide means. As can be seen in FIG. 6, the pillow block roller bearings 60 and 62 permit the outermost ends of the arbor 50 to be deflected upwardly at an angle "A" of up to about 4° from the horizontal depending on the weight exerted by the strip "S" on the roller means "R". The openings in the walls 52 and 54 of the furnace 30 are of sufficient dimension to permit such angular deflection of the ends of roller means "R". And, as noted previously, the strip "S" being relatively thin, i.e., approximately 1.5 to 2.5 inches, becomes quite soft and malleable and thus sags across its width to conform to the catenary shape of the roller means "R" when heated to the working temperatures within the furnace 30. The sagging of the plurality of roller means "R" and hence the strip "S" conforming thereto serves to self-center and gently guide the strip "S" along the roller means during its passage through the furnace 30 without the need for any additional guide means within the furnace which might cause damage to the softened strip as it passes thereby.

Figure 7:
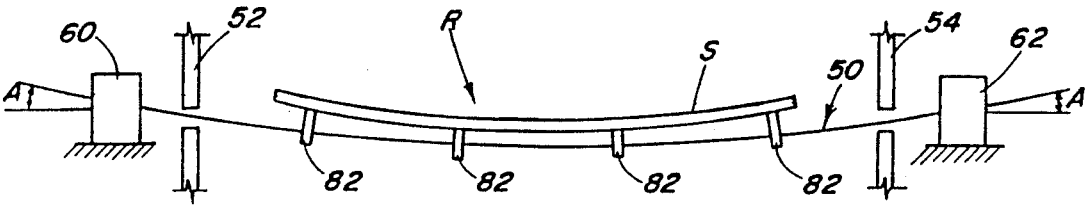
FIG. 7 is a schematic view similar to FIG. 6 illustrating a second embodiment of the roller apparatus of the present invention for enhancing the guidance of a workpiece through a furnace structure.

Referring now to FIG. 7, it can be seen that the centering effect of the strip "S" on the roller means "R" may be enhanced, if desired, by providing wheel means 82 of lesser diameter near the midpoint of the arbor and of greater diameter near the ends of the arbor.

The design of the roller means "R", particularly the wheel means is a major advancement in this art. The provision of a non-continuous web reduces the conduction heat losses from the surface of the roller means. The outer surface of the roller means because it cannot easily conduct heat away is hotter and less likely to cool the strip or workpiece. The hotter outer surface of the wheel means will cause high (excessive) thermal stress due to the high expansion rate of the material used to construct the wheel means. Such thermal stresses are accommodated by in design and attachment method to the arbor 50. The finger type attachment to the water cooled shaft permits deflection in the attachment which reduces thermal stresses. The limited weld and contact surface area to the water cooled shaft further reduces heat loss and aids in reducing stress.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

I claim:

1. Roller apparatus for conveying and guiding a workpiece through a heating furnace, said apparatus comprising:

arbor means;

bearing means for rotatably supporting opposite ends of said arbor means;

wheel means spaced along the length of and secured externally to said arbor means, radially outermost surfaces of said wheel means serving to support a workpiece during conveyance thereof through said heating furnace, said wheel means including a base means joined by web portions to a rim means, said web portions being separated by openings for reducing the cross sectional area of said web means to impede the heat flow from said rim means to said base means, said base means including a plurality of angularly spaced base members, said base members each comprising a toe portion and a head portion;

weld metal connecting only said toe portions to said arbor means for permitting said head portions to slide relative to said arbor means in response to differential expansion and bending of said arbor means;

means for thermally insulating said arbor means, said means for thermally insulating substantially covering all portions of said arbor means between adjacent ones of said wheel means and between said wheel means and wall portions of said furnace; and means for rotating said arbor means.

2. The apparatus of claim 1 wherein said arbor means include fluid coolant passage means axially extending therethrough, said apparatus comprising means associated with said fluid passage means for circulating coolant fluid through said fluid passage means.

3. The apparatus of claim 2 wherein said arbor means comprise an inner tubular member and an outer tubular member concentrically arranged about said inner tubular member.

4. The apparatus of claim 3 wherein said fluid coolant passage means comprise an inner fluid passage within said inner tubular member and an annular fluid passage between said inner and outer tubular members.

5. The apparatus of claim 1 wherein said means for thermally insulating said arbor means comprise packets of laminar abutting discs of thermally insulating material.

6. The apparatus of claim 5 wherein said discs are of a lesser diameter than the diameter of said wheel means.

7. The apparatus according to claim 1 wherein said weld metal connects side parts of said toe portions to said arbor means.

8. The apparatus according to claim 7 wherein said toe portion and said head portion of each said base member are spaced apart by a gap extending in the direction of the length of said arbor means.

9. Roller apparatus for use in a heating furnace and for conveying and guiding a workpiece through said heating furnace, said apparatus comprising:

arbor means, said arbor means being deflectable to a catenary configuration when the weight of a workpiece is supported thereon;

bearing means for rotatably supporting and permitting limited deflection of opposite ends of said arbor means;

means for rotating said arbor means, said means for rotating including motor means and flexible coupling means interconnecting said arbor means and said motor means; and workpiece supporting means secured to said arbor means, whereby said workpiece supporting means serve to center said workpiece on said roller apparatus to guide the workpiece through the furnace when the arbor means is rotated by said means for rotating and deflected by the weight of the workpiece.

10. The apparatus of claim 9 wherein said workpiece supporting means comprise wheel means spaced along the length of and secured to said arbor means, radially outermost surface means of said wheel means serving to support said workpiece during conveyance thereof through said heating furnace.

11. Roller apparatus for conveying and guiding a workpiece through a heating furnace, said apparatus comprising:

arbor means including fluid coolant passage means extending therethrough, said arbor means being deflectable to a catenary configuration when the weight of a workpiece is supported thereon;

means associated with said fluid coolant passage means for circulating coolant fluid through said fluid coolant passage means;

bearing means for rotatably supporting and permitting limited deflection of opposite ends of said arbor means;

means for rotating said arbor means;

wheel means spaced along the length of and secured to said arbor means, radially outermost surfaces of said wheel means serving to support a workpiece during conveyance thereof through said heating furnace;

means for thermally insulating said arbor means, said means for insulating substantially covering all portions of said arbor means between adjacent ones of said wheel means and between said wheel means and wall portions of said furnace, whereby said wheel means serve to center a workpiece on said roller apparatus to guide the workpiece through the furnace when the arbor means is rotated by said means for rotating and deflected by the weight of the workpiece.

12. The apparatus of claim 11 wherein said means for rotating comprise motor means and flexible coupling means interconnecting said arbor means and said motor means.

13. The apparatus of claim 12 wherein said means for thermally insulating said arbor means comprise packets of laminar abutting discs of thermally insulating material.

14. The apparatus of claim 13 wherein said discs of a lesser diameter than the diameter of said wheel means.

15. The apparatus of claim 14 wherein said discs are flexible.

16. Roller system for conveying and guiding a workpiece through a heating furnace, said system comprising a plurality of roller means extending in spaced parallel relation along the length of said furnace, the axial length of each roller means being transverse to the direction of conveyance of said workpieces through said furnace, each of said roller means comprising:

arbor means including fluid coolant passage means extending therethrough, said arbor means being deflectable to a catenary configuration when the weight of a workpiece is supported thereon;

means associated with said fluid coolant passage means for circulating coolant fluid through said fluid coolant passage means;

bearing means for rotatably supporting and permitting limited deflection of opposite ends of said arbor means;

means for rotating said arbor means;

wheel means spaced along the length of and secured to said arbor means, radially outermost surfaces of said wheel means serving to support a workpiece during conveyance thereof through said heating furnace, said wheel means of each of said plurality of roller means being arranged in staggered relation to the wheel means of a roller means positioned immediately adjacent thereto; and means for thermally insulating said arbor means, said means for insulating substantially covering all portions of said arbor means between adjacent ones of said wheel means and between said wheel means and wall portions of said furnace;

whereby said wheel means serve to center a workpiece to guide the workpiece through the furnace when the arbor means is rotated by said means for rotating and deflected by the weight of the workpiece.

* * * * *